US008485084B1

(12) United States Patent
Cannon

(10) Patent No.: US 8,485,084 B1
(45) Date of Patent: Jul. 16, 2013

(54) MULTI-AXIAL EXPLOSIVE, LATERALLY-SHEARING, REACTIVE MECHANISM

(75) Inventor: Joseph P. Cannon, Lenox, MI (US)

(73) Assignee: The United States of America as a represented by the Secretary of the Army, Washington, DC (US)

( * ) Notice: Subject to any disclaimer, the term of this patent is extended or adjusted under 35 U.S.C. 154(b) by 117 days.

(21) Appl. No.: 13/559,381

(22) Filed: Jul. 26, 2012

Related U.S. Application Data

(62) Division of application No. 12/948,250, filed on Nov. 17, 2010, now Pat. No. 8,272,311.

(51) Int. Cl.
*F41H 11/00* (2006.01)

(52) U.S. Cl.
USPC ..... 89/36.17; 109/36; 109/37

(58) Field of Classification Search
USPC ..... 89/36.01–36.17; 109/36, 37
See application file for complete search history.

(56) References Cited

U.S. PATENT DOCUMENTS

| | | | | |
|---|---|---|---|---|
| 3,611,932 | A | 10/1971 | Clator | |
| 4,662,288 | A * | 5/1987 | Hastings et al. | 109/2 |
| 4,665,794 | A | 5/1987 | Gerber et al. | |
| 5,012,721 | A | 5/1991 | Medin et al. | |
| 5,025,707 | A | 6/1991 | Gonzalez | |
| 5,637,824 | A | 6/1997 | Benyami | |
| 5,824,941 | A | 10/1998 | Knapper | |
| 5,859,383 | A | 1/1999 | Davison et al. | |
| 6,345,563 | B1 | 2/2002 | Middione et al. | |
| 6,880,445 | B2 * | 4/2005 | Benyami et al. | 89/36.17 |
| 7,077,048 | B1 | 7/2006 | Anderson et al. | |
| 7,424,845 | B2 | 9/2008 | Zank et al. | |
| 7,603,939 | B2 | 10/2009 | Cohen | |
| 8,069,771 | B1 * | 12/2011 | MacDougall | 89/36.17 |
| 2006/0065111 | A1 * | 3/2006 | Henry | 89/36.02 |
| 2007/0089595 | A1 * | 4/2007 | Shah et al. | 89/36.02 |
| 2010/0043630 | A1 * | 2/2010 | Sayre et al. | 89/36.02 |
| 2010/0282062 | A1 * | 11/2010 | Sane et al. | 89/36.02 |
| 2011/0283873 | A1 * | 11/2011 | Wadley et al. | 89/36.02 |
| 2012/0125187 | A1 * | 5/2012 | Hunn | 89/36.02 |

OTHER PUBLICATIONS

Field Manual 5-250. Explosives and Demolitions. Jun. 15, 1992.

* cited by examiner

*Primary Examiner* — Samir Abdosh
(74) *Attorney, Agent, or Firm* — David L. Kuhn; Thomas W. Saur; Luis Miguel Acosta

(57) ABSTRACT

Reactive armor that includes a casing having a plurality of walls, a back, and a cavity formed therebetween; a cover that closes the cavity and forms a strike face; a filler placed within the cavity, the filler comprising a disruptive material; and an explosive. To defeat projectile or projectile related threats, the reactive armor substantially, but not necessarily wholly, implements laterally oriented force mechanisms, erosion mechanisms, and bulking mechanisms, e.g., explosive forces, with respect to the strike face.

2 Claims, 9 Drawing Sheets

MULTI-AXIAL EXPLOSIVE, LATERALLY-SHEARING, REACTIVE MECHANISM

CROSS-REFERENCE TO RELATED APPLICATIONS

This application is a divisional application of application Ser. No. 12/948,250, filed Nov. 17, 2010 now U.S. Pat. No. 8,272,311.

GOVERNMENT INTEREST

The invention described here may be made, used and licensed by and for the U.S. Government for governmental purposes without paying royalty to me.

BACKGROUND OF THE INVENTION

1. Field of the Invention

The present invention generally relates to reactive armor.

2. Background Art

Conventional reactive armor implementations, as known to one of skill in the art, are shown, in some examples, in U.S. Pat. Nos. 4,665,794; 5,012,721; 5,025,707; 5,637,824; 5,824,941; 6,345,563; 6,880,445; 7,077,048; 7,424,845; and 7,603,939; and U.S. Application Publication 2006/0065111. A further reference noted, as known to one of skill in the art, is U.S. Army Field Manual 5-250, Explosives and Demolitions, June 1992 (hereinafter, FM 5-250).

In U.S. Pat. No. 5,025,707, ('707), a reactive armor (e.g., a protective apparatus or device) is disclosed that has disruptive material which impinges on a penetrating threat to destroy the integrity of the threat and prevent incursion into the interior of an armored vehicle (or other protected region) (see, Abstract, and Detailed Description at col. 2, lines 39-46). The use of lateral oriented (with respect to a nominal strike face) force mechanisms to defeat projectile threats including shaped charged threats are found, for example, in U.S. Pat. No. 5,824,941 ('941) (see, FIG. 1 and related description especially at col. 2, lines 19-28), in U.S. Pat. No. 4,665,794 ('794) (see, FIG. 1 and related discussion at col. 2, lines 36-57—random orientation of elements 3 will inherently cause lateral forces for some orientations of projectile impact and defeat element alignment), and in the U.S. Application No. 2006/0065111 ('111) (see, FIGS. 12-19 and related discussion in paragraphs [0067]-[0071]). The '111 application also discloses sequenced interaction, as does U.S. Pat. No. 6,345,563 ('563) (see the Fig. and related description at col. 2, lines 51-67), the '707 patent (see description at col. 4, lines 1-11) and U.S. Pat. No. 6,880,445 ('445) (see, for example, FIG. 5C and description at col. 5, lines 15-22). Further examples of substantially lateral force defeat of projectile impingement are described in U.S. Pat. No. 5,012,721 (on FIG. 2 and at col. 3, lines 43-47); U.S. Pat. No. 5,637,824 ('824) (on FIGS. 2(a)-2(d) and at col. 4, line 47 bridging through col. 5, line 7); and U.S. Pat. No. 7,424,845 (FIGS. 1 and 2).

The projectile defeat use of glass or ceramic material that is block, sheet or plate shaped, or round (cylindrical) rod (tube or pellet) or hex shaped rod (or pellet) material are shown, for example, in the '111 application on FIGS. 2 and 3; the '794 patent on FIGS. 7-9; the '941 patent as element 14 in FIG. 1, the '824 patent on FIGS. 2(*a*)-2(*d*) and at col. 3, lines 52-59; in U.S. Pat. No. 7,077,048 as element 140 on FIG. 6B; and in U.S. Pat. No. 7,603,939 on FIG. 2.

The use of sheet (or foil) explosive on the bottom and a plurality of walls of the protective device is disclosed in, for example, the '941 patent, the '563 patent (element 31), and the '445 patent on FIGS. 3, 4, and 5A-5D).

The placement of explosive material in a cross shape is illustrated, for example, in the '445 patent on FIGS. 2 and 3.

The use of a plurality of rod shaped explosive elements distributed within the protective device is disclosed in, for example, the '794 patent as element 5, and the '563 patent as elements 14 and 19. In the '563 patent, the rod explosive elements are implemented in connection with sheet explosive (element 31) at the back of the protective device.

The implementation of detonation cord in connection with other explosive and non-explosive elements by way of positioning, placement, threading, tying, weaving, and the like is illustrated, for example, in FM 5-250, on FIGS. 2-14 and 15, 2-19, 2-20, and 2-27 through 2-29.

However, conventional reactive armor generally presents compromises and limitations in performance, generally manifested as potential hazard to nearby individuals and/or equipment, collateral damage, and the like. As such, there is a desire for improved reactive armor.

SUMMARY OF THE INVENTION

The present invention is directed to reactive armor (e.g., a reactive armor system, a protective device, apparatus, and the like). In accordance with the reactive armor of the present invention, substantially (predominantly) but not necessarily wholly laterally oriented (with respect to a nominal strike face) force mechanisms (e.g., explosive forces) may be implemented to defeat projectile or projectile related threats while potentially minimizing collateral damage, fratricide, or injury. In particular, projectile defeat via use of pre-fragmented or fragmentable (e.g., glass, borosilicate glass, ceramic, or the like) material that is, for example, in blocks, plate shaped, sheets, round (cylindrical) rod (or pellet), hex shaped rod (or pellet) material; wherein, a plurality of particles may be implemented or generated and rapidly forced into the projectile and projectile intrusion when the fragmentable material is shattered by explosive forces. The explosive forces may be sequenced to achieve the desired disruptive effects.

The above features, and other features and advantages of the present invention are readily apparent from the following detailed descriptions thereof when taken in connection with the accompanying drawings.

DETAILED DESCRIPTION OF THE PREFERRED EMBODIMENT(S)

Figure 1:
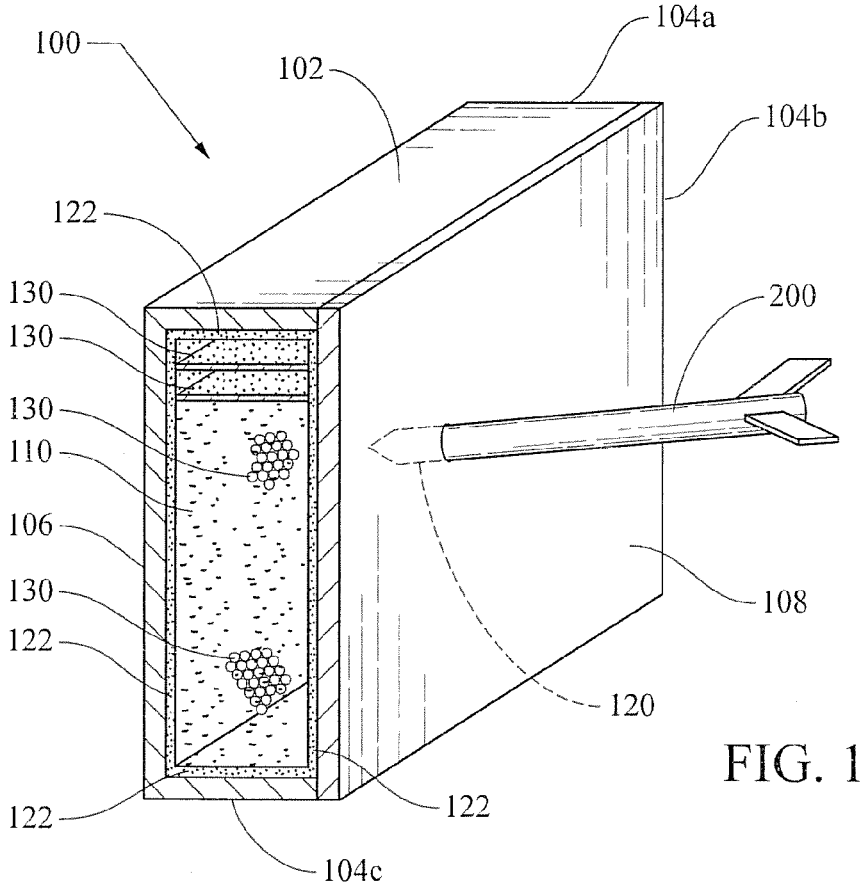
FIG. 1 is an isometric, partially sectioned, view of an embodiment of a reactive armor according to the present invention.

Definitions and terminology: The following definitions and terminology are applied as understood by one skilled in the appropriate art. The singular forms such as "a," "an," and "the" include plural references unless the context clearly indicates otherwise. For example, reference to "a material" includes reference to one or more of such materials having the same or similar properties. As used herein, "essentially", "substantial" and "about", when used in reference to a quantity or amount of a dimensional unit, material, characteristic, parameter, and the like, refer to an amount or quantity that is sufficient to provide an effect that the material or characteristic was intended to provide as understood by one skilled in the art. The amount of variation generally depends on the specific implementation.

With reference to the Figures, the preferred embodiments will now be described in detail. Generally, the present invention provides an improved system for reactive armor. Structures that may be protected by a reactive armor according to the present invention are vehicles such as tanks, armored personnel carriers, armored fighting vehicles, armored static structures such as buildings, above-ground portions of bunkers or shelters, containers for the storage of water, fuel, chemicals, munitions, and the like. The reactive armor system according to the present invention may be implemented as stand-alone armor, or alternatively may be implemented in connection with (e.g., integrated with) conventional passive armor.

One embodiment is generally directed to reactive armor that includes a casing having a plurality of walls; a back; and a rectangular shaped cavity formed therebetween; a cover that closes the cavity and forms a strike face; a filler placed within the cavity, the filler comprising a disruptive material; and an explosive. The cavity includes sheets of the explosive having edges facing the strike face, the placement of the sheets of the explosive when viewed from the strike face is implemented as four sheets of the explosive that are positioned with major faces against essentially half of a respective inner surface of a wall such that no two sheets of the explosive are adjacent to each other, and such that no two sheets of the explosive directly face each other, and the spaces at the wall that results from the implementation of the explosive on one half of the inner surface of the wall is filled with first sheets of the filler.

The filler further comprises a plurality of second sheets sized similarly to and parallel to the sheets of explosive, and the second sheets of the filler having edges facing the strike face, and the second sheets of the filler are arranged and positioned in four first groupings that are perpendicular to one another within the casing.

The second sheets of the filler may be at least twice as thick as the sheets of the explosive.

Interior to the sheets of the explosive and the first sheets of the filler, the cavity is filled with a plurality of adjacent rods of the filler material having ends facing the back and the strike face. The rods of the filler may be implemented as rows having alternating hexagonal and cylindrical shape, that is, one row of rods of the filler having a hexagonal cross section followed by a row of rods of the filler having a circular cross section. The rods of the filler may be implemented as nested rows having hexagonal shape. The rods of the filler may be implemented as rows having cylindrical shape.

Interior to the sheets of the explosive and the first sheets of the filler, the cavity may be filled with filler that comprises one of (i) a plurality of second sheets or (ii) a block having the major faces positioned to face the back and the strike face.

The explosive may be further implemented within the casing in connection with at least one of the back and the cover as comb shaped quadrants that are at 90 degree intervals of rotation to one another, where each of the quadrants has a first leg that is substantially adjacent to a one half of a respective wall, and a plurality of second legs that extend perpendicular from one side of the respective first leg, and that are directed towards the center of the casing.

The explosive may be further implemented within the casing in connection with at least one of the back and the cover in four second groupings that are at 90 degree intervals of rotation to one another, and each of the second groupings has a first leg that substantially bisects one half of a respective wall and is perpendicular to the respective wall, and a pair of a plurality of second legs that extend perpendicular from a respective first leg and that are directed outward from both sides of the first leg substantially parallel to the wall that is intersected by the first leg, and that are staggered such that the second legs on opposite sides of the first leg do not intersect at the first leg.

Another embodiment may be directed to reactive armor that includes a casing having a plurality of walls; a back; and a rectangular shaped cavity formed therebetween; a cover that closes the cavity and forms a strike face; a filler placed within the cavity, the filler comprising a disruptive material; and an explosive, wherein the cavity includes the explosive interspersed within the cavity between elements of the filler.

The filler may be implemented as adjacent cylindrical rods having circular cross sectional ends that face the back and the strike face and, the explosive is implemented as at least one of cylindrical sticks, rods, and detonation cord that is inserted or threaded in the spaces between the rods of the filler.

The filler may be implemented as adjacent cylindrical rods having circular cross sectional ends that face the back and the strike face, and the filler is implemented in quadrants within the casing wherein the quadrants are defined by sheets of the explosive traversing the interior in a substantially "cross" shape that bisects each of the walls.

The armor cavity may include sheets of the explosive having edges facing the strike face and sheets of the filler having edges facing the strike face, the sheets of the explosive and the sheets of the filler are arranged and positioned in four first groupings within the casing such that adjacent first groupings are perpendicular to one another, the placement of the sheets of the explosive when viewed from the strike face is implemented as a pair of broken-Ts where sheets of the explosive are sandwiched substantially centrally within of the sheets of the filler in the first groupings and oriented upside down with respect to each other.

The explosive may be further implemented within the casing in connection with at least one of the back and the cover in four second groupings that are at 90 degree intervals of rotation to one another, and each of the second groupings has a first leg that substantially bisects one half of a respective wall and is perpendicular to the respective wall, and a pair of a plurality of second legs that extend perpendicular from a respective first leg and that are directed outward from both sides of the first leg substantially parallel to the wall that is intersected by the first leg, and that are staggered such that the second legs on opposite sides of the first leg do not intersect at the first leg.

Yet another embodiment is generally directed to reactive armor including a casing having a plurality of walls, a back, and a rectangular shaped cavity formed therebetween; a cover that closes the cavity and forms a strike face; a filler placed within the cavity, the filler comprising a disruptive material; and an explosive, wherein, two sheets of the explosive are implemented on the interior surfaces of an opposing pair of the walls.

The filler may further include a plurality of sheets, and the sheets of the filler having edges facing the strike face, the sheets of the filler are positioned with major faces against essentially half of a respective inner surface of a wall and the sheets of the filler are arranged and positioned in four groupings wherein adjacent groupings are perpendicular to one another within the casing.

The filler further may further include a plurality of adjacent sheets of the filler placed with major faces parallel to the sheets of the explosive and with edges positioned to face the back and the strike face.

The filler may further comprise a plurality of adjacently placed rods that are oriented with the longitudinal axes facing the strike face and having the ends directed at the walls not having the explosive on the interior surface.

The explosive may be further implemented within the casing as a plurality of trough configured shaped charges that are positioned to impinge directed forces on the major faces of the sheets of the filler.

Figure 2:
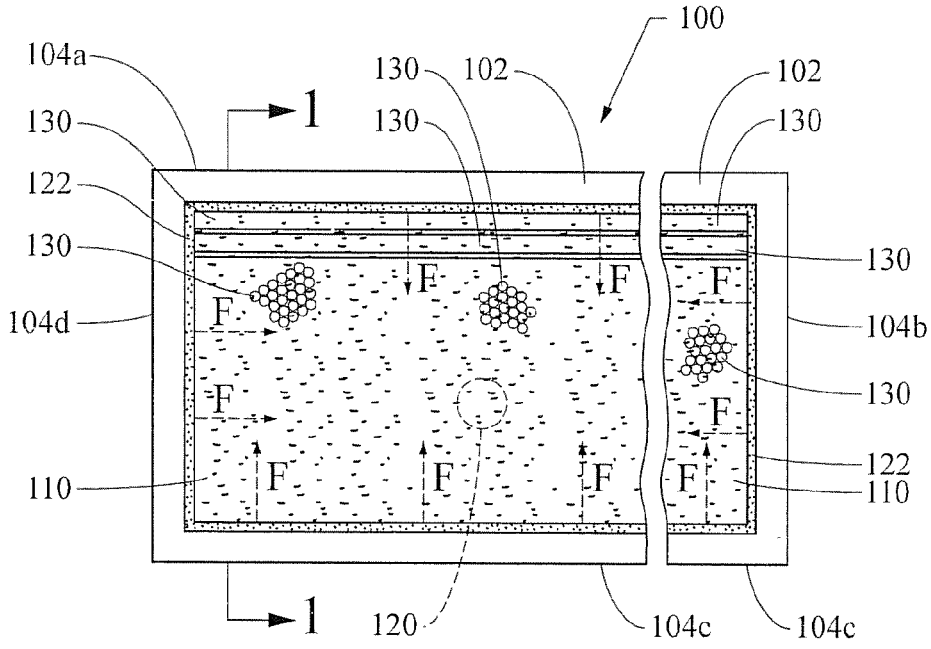
FIG. 2 is a plan view of the interior components of the armor of FIG. 1.

Referring to FIGS. 1 and 2, an embodiment of a reactive armor (i.e., protective system, apparatus, device, etc.) 100 is shown. Referring to FIG. 1, a sectional view along the 1-1 line of FIG. 2 is shown. The reactive armor 100 generally comprises a casing 102, wherein the casing 102 generally includes four walls (e.g., walls 104*a*-104*d*), a back (or base) 106 which is generally positioned away from threats, and a top cover 108 which is nominally (i.e., in most instances) a metal strike face that is subjected to impact from a threat 200. The walls 104 and the back 106 generally form a box-shaped (e.g., prismatic, orthorhombic, cubical, and the like) cavity (e.g., an interior) 110 inside of the casing 102, and the cavity 110 may be closed by the cover 108.

FIG. 2 is a plan view of the armor 100 illustrating the interior of the cavity 110 of the armor with the cover 108 removed for clarity, and broken to illustrate that the dimensions may be varied to meet the design criteria of a particular application. The reactive armor 100 is generally implemented with the casing 102 as a substantially rectangular or square shape when viewed from the strike face as illustrated in FIG. 2. However, other shapes (e.g., circular, oval, hexagonal, irregular, etc.) for the casing 102 may be implemented to meet the design criteria (e.g., shape of the area to be protected) of a particular application. The number of walls 104 will generally correspond to the shape of the cavity 110. For example, when the armor 100 is implemented having a cylindrical shaped cavity 110, there will be a single circular wall 104; and when the armor 100 is implemented having a hexagonal shaped cavity 110, there will be a six walls 104 (e.g., walls 104*a*-104*f*). The cover 108 is generally implemented as a removable top that is fastened to the casing 102 via conventional techniques and devices such as bolts, screws, pins, and the like.

When impacting the armor 100, the threat 200 generally causes an intrusion 120 into the cavity 110. The threat 200 and respective intrusion 120 may be one or more projectiles, metal fragments, fluid metals, penetrating jets ("thorns", "spikes", etc.) as generated by chemical energy rounds, high energy kinetic rounds, and the like. The armor 100 may potentially mitigate, disrupt, diminish, reduce, and/or eliminate damaging or harmful effects of the intrusion 120 from the threat 200 and collateral effects. The armor 100 is generally positioned such that the cover 108 faces the anticipated direction of the threat 200, and the area to be protected is thus behind the back 106.

Inside the cavity 110, an explosive (e.g., propellant, pyrotechnic, and the like) 122 may be implemented (e.g., applied, placed, affixed, installed, or the like) as at least one of sheets (flat and shaped), lines, strips, cords, rods, and arrays (matrices) on at least one of one or more of the walls 104, the casing back 106, and the cover 108; and a fragmentable disruptive filler material 130 may be implemented as a filler to the cavity 110. The explosive 122 may also extend away from one or more of the walls 104, the back 106, and the cover 108 in the form of one or more granules, rows, sheets, panels, cords, lines, and/or rods into, interstitial to, intermingled with, overlapping with, dispersed within, threaded or woven within, and the like, relative to the filler material 130. When initiated (i.e., ignited, activated, exploded, set off, etc.), the explosive 122 may generate an force, F (shown in phantom). The force, F, alone and generally in combination with the filler 130 may disrupt the intrusion 120.

The explosive 122 that extends into the filler 130 area may be adjacent to or contiguous with the explosive 122 that may be implemented on or against the walls 104, the casing back 106, and the cover 108. The area of coverage on the walls 104 and the casing back 106, as well as the configuration (e.g., composition, potency, type, shape, diameter, thickness, height, width, etc.) of the explosive 122 may be chosen (e.g., calculated, determined, devised, etc.) to meet the design criteria of a particular application (e.g., initiation, sequencing, and direction of the resultant explosive forces, anticipated threat, construction of the casing 102, type and configuration of the explosive 122, type and configuration of material 130, and the like). Further embodiments of the configuration of the type and coverage of the explosive 122 and the filler material 130 are illustrated on FIGS. 3-16, and described in detail below.

The filler 130 comprises a penetrator resistant (e.g., disruptive) material such as sand, glass, ceramic (e.g., silicon nitride, silicon carbide, zirconia, alumina, and the like), borosilicate glass, and the like that are placed within the cavity 110. In some examples, the disruptive filler material 130 may be implemented in a pre-fragmented (e.g., particulate, balls, granules, grains, and the like) state as illustrated on FIGS. 1 and 2.

In other examples, the fragmentable disruptive material 130 may be implemented shaped as blocks; sheets; plates; tiles; rods having cylindrical, hexagonal, or other cross sectional shape; and the like that are placed within the cavity 110. When implemented as blocks, sheets, or plates, the fragmentable material 130 may be implemented having major faces towards the walls 104 in some examples, and implemented having major faces towards the back 106 and the cover 108 in other examples, and in combinational arrangement in yet other examples.

The intrusion 120 generally detonates the explosive 122 such that the explosive material 122 may perform as an initiator and also provide further explosive force generation. That is, the intrusion 120 generally detonates the explosive 122 such that substantially lateral (i.e., inward from the walls 104 and towards the intrusion 120) forces cause the filler 130 to disrupt the intrusion 120 (e.g., via erosion mechanisms and bulking mechanisms). Implementation of such substantially lateral forces, rather than substantially outward (i.e., away from the back 106 and towards the cover 108) forces generally keep the forces and fragmented material 130 inside of the cavity 110, and may potentially reduce the risk of damage to equipment, fratricide, or injury to nearby individuals external to the system 100.

Referring to FIGS. 3-13, embodiments of the armor 100 illustrating the interior 110 of the armor with the cover 108 removed (i.e., plan views) are shown. For simplicity but not as a limitation, the casing 102 is shown having a substantially square shape.

Figure 3:
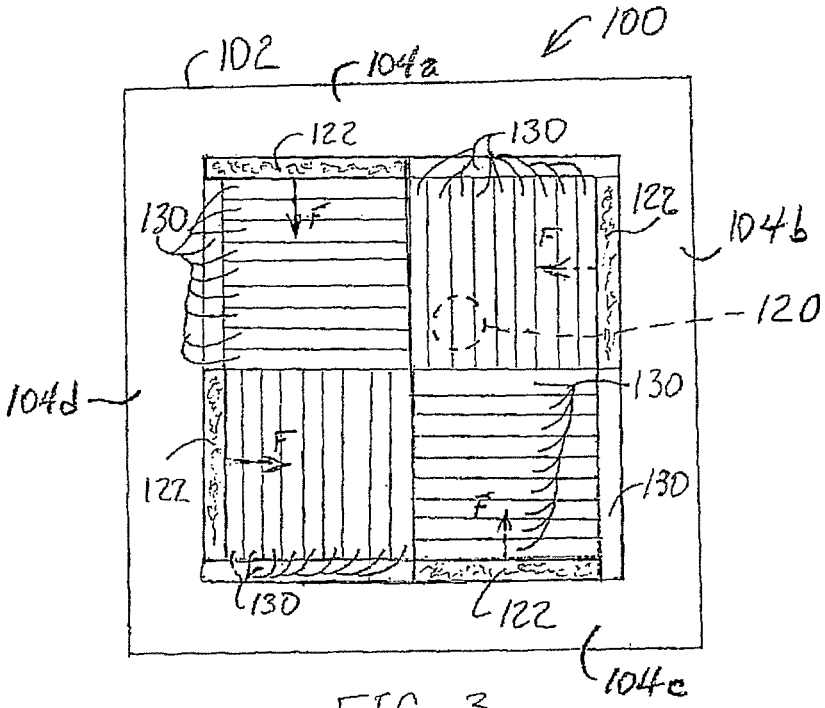
FIGS. 3-13 are plan views of other embodiments of reactive armor according to the present invention.
Figure 4:
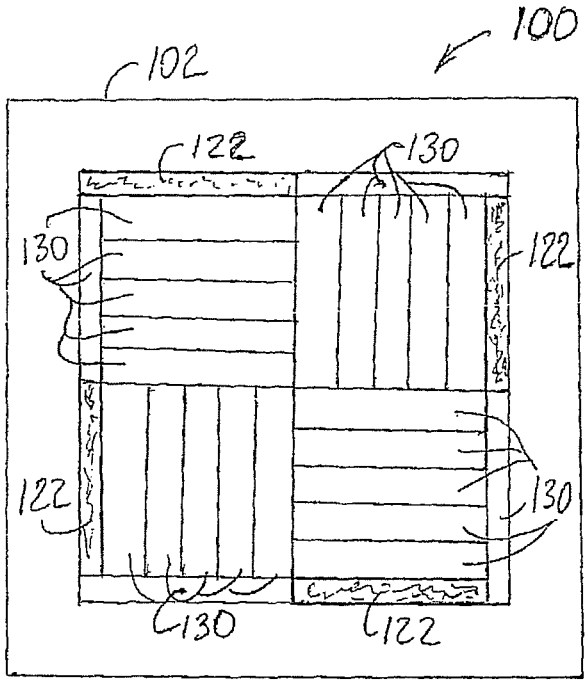

Referring to FIGS. 3 and 4, the interior cavity 110 includes sheets of the explosive 122 and sheets (or plates) of the filler 130 having respective edges facing outward (i.e., toward the strike face 108). The sheets of the explosive 122 and the sheets of the filler 130 are arranged and positioned in quadrants (i.e., in four groupings) that are perpendicular (i.e., rotated 90 degrees) to one another within the casing 102. Four sheets of the explosive 122 are positioned with major faces against (adjacent to) essentially (e.g., about, substantially, and the like) half of a respective wall 104 such that no two sheets of the explosive 122 are adjacent to each other, and such that no two sheets of the explosive 122 directly face each other. The space (gap) at the wall 104 that results from the implementation of the explosive 122 on one half of the inner surface of the wall 104 is generally filled with first sheets of the filler 130. A plurality of second sheets of the filler 130 sized similarly to and parallel to the sheets of explosive 122 extend inward. In the embodiment of the armor 100 that is illustrated on FIG. 4, the second sheets of the filler 130 that are interior within the cavity 110 relative to the sheets of the explosive 122 may be implemented significantly thicker (e.g., at least twice as thick) as the sheets of the explosive 122.

Figure 5:
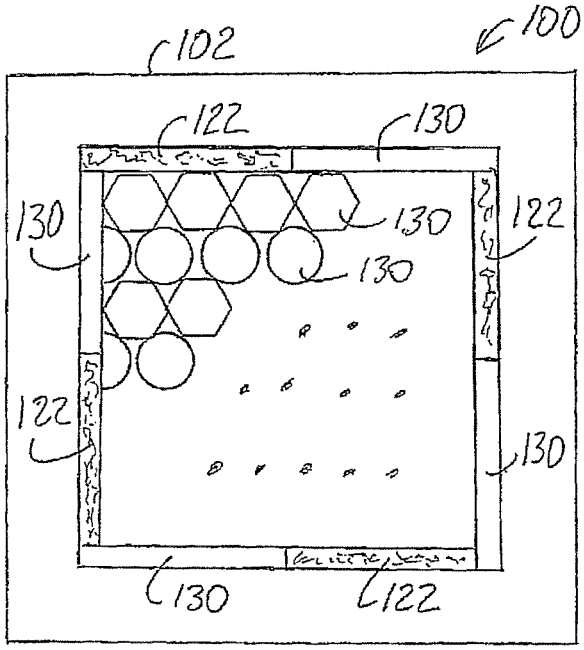
Figure 6:
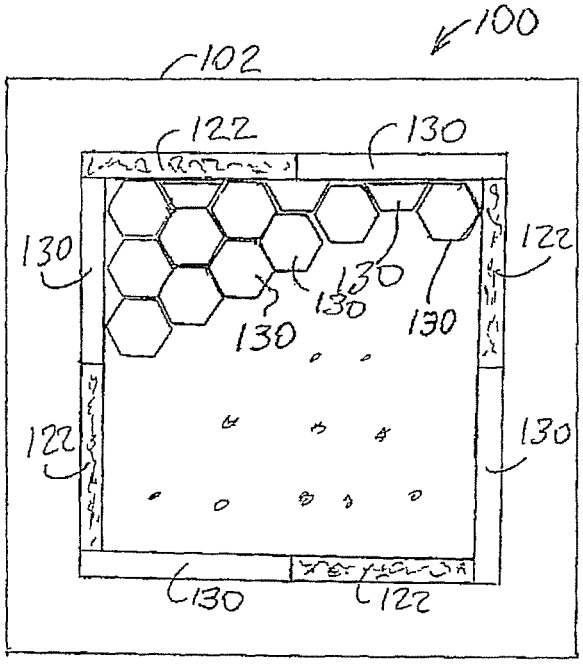
Figure 7:
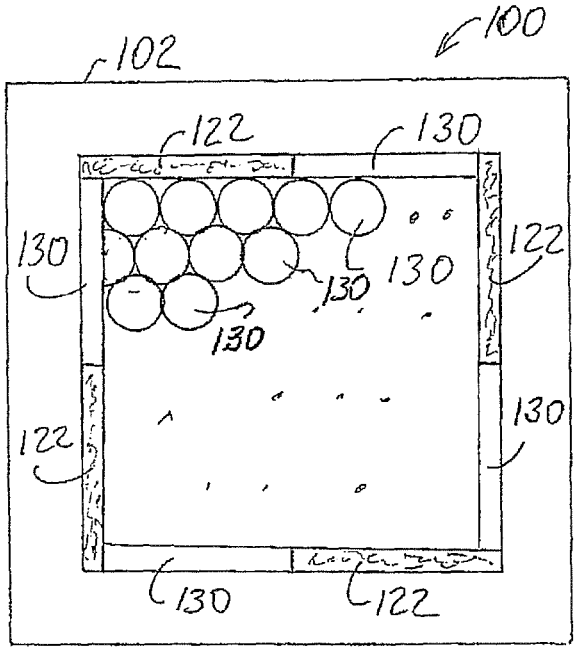

Referring to FIGS. 5-7, the sheets of the explosive material 122 may be implemented on the interior of walls 104 similarly to the embodiments of the armor 100 that are illustrated in FIGS. 3 and 4. Likewise, sheets of the filler 130 may be implemented adjacent to the walls 104 to fill the gaps along the walls 104. Interior to the sheets of the explosive 122 and the sheets of the filler 130, the cavity 110 is generally filled with adjacent rods of the filler material 130 having ends facing the back 106 and the strike face 108.

In the embodiment of the armor 100 illustrated on FIG. 5, the rods of the filler 130 are generally implemented as rows (or columns) having alternating hexagonal and cylindrical shape, that is, one row of rods of the filler 130 having a hexagonal cross section followed by a row of rods of the filler 130 having a circular cross section. In the embodiment of the armor 100 illustrated on FIG. 6, the rods of the filler 130 are generally implemented as nested rows (and columns) having hexagonal shape. In the embodiment of the armor 100 illustrated on FIG. 7, the rods of the filler 130 are generally implemented as rows (and columns) having cylindrical shape.

Figure 8:
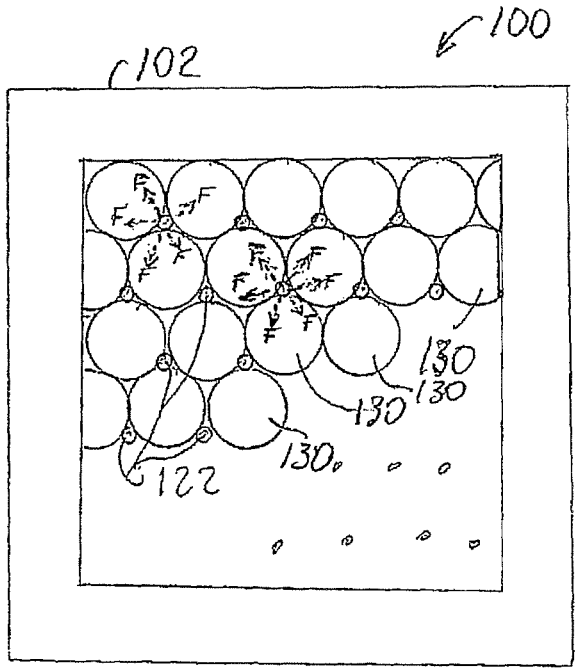

Referring to FIG. 8, the filler 130 may be implemented as adjacent cylindrical rods having circular cross sectional ends that face the back 106 and the strike face 108 similar to the embodiment of the armor 100 that is illustrated on FIG. 7; however, the explosive 122 may be implemented as cylindrical sticks, rods, or detonation cord that is inserted or threaded (woven) in the spaces (gaps) between the rods of the filler 130. When the explosive 122 is implemented as a continuous cord, the explosive 122 generally extends across the inner surfaces of the back 106 and the cover 108 between the rods of the filler 130. Similarly, the explosive 122 may be implemented as a powder, grains, granules, or the like that is placed (dispersed) in the spaces between the rods of the filler 130.

Figure 9:
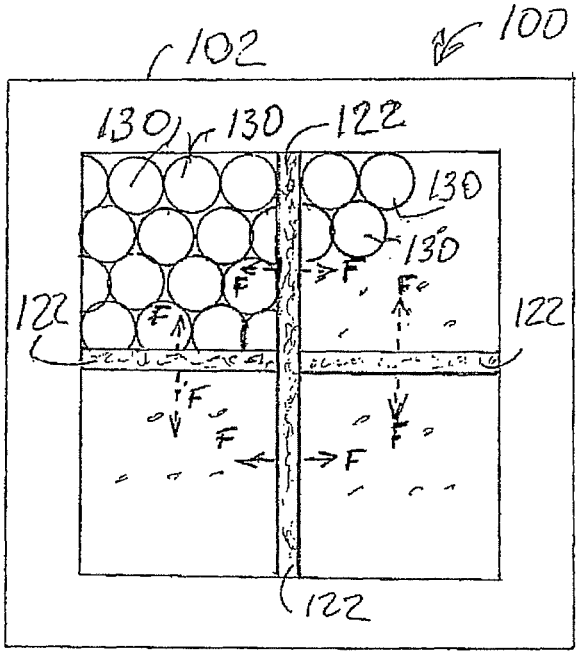

Referring to FIG. 9, the filler 130 may be implemented as adjacent cylindrical rods having circular cross sectional ends that face the back 106 and the strike face 108 similar to the embodiment of the armor 100 that is illustrated on FIGS. 7 and 8; however, the filler 130 may be implemented in quadrants within the casing 102 that are defined by sheets of the explosive 122 traversing the interior 110 in a substantially "+" ("plus" or "cross") shape that bisects each of the walls 104.

Figure 10:
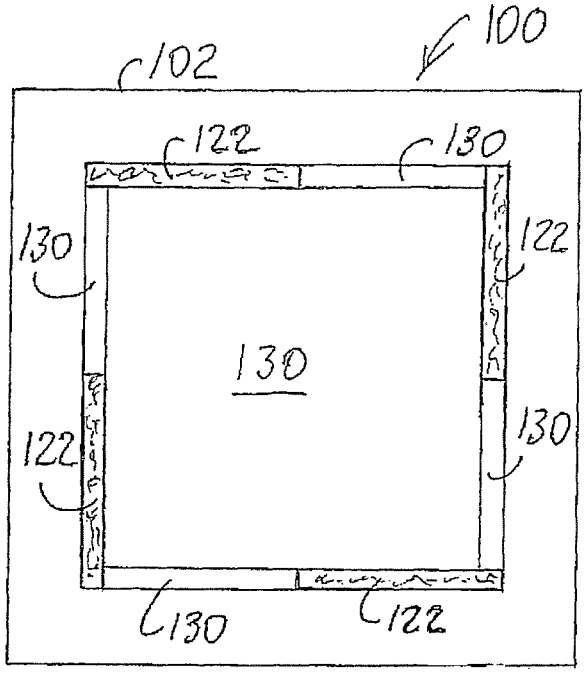

Referring to FIG. 10, the sheets of the explosive material 122 may be implemented on the interior of the walls 104 similarly to the embodiments of the armor 100 that are illustrated on FIGS. 3-7. Likewise, sheets of the filler 130 may be implemented adjacent to the walls 104 to fill the gaps along the walls 104. The remainder of interior 110 to the casing 102 may be filled with the fragmentable filler material 130 in the form of sheets or a block having the major faces positioned to face the back 106 and the strike face 108.

Figure 11:
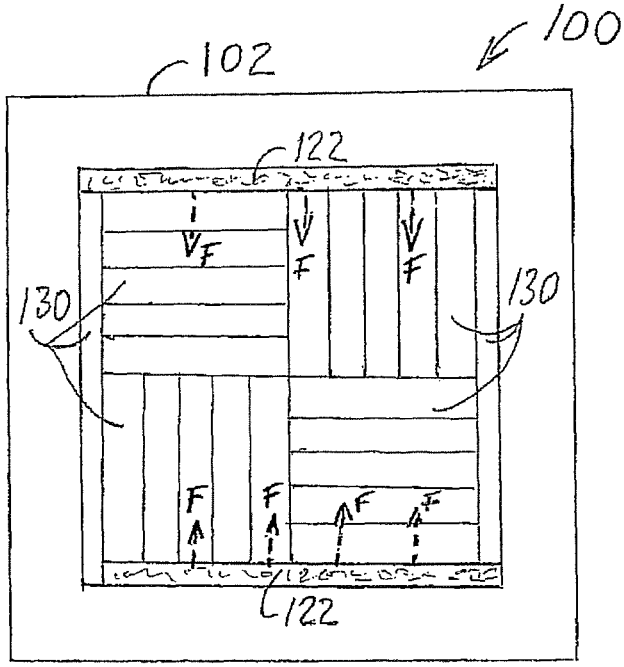

Referring to FIG. 11, two sheets of the explosive material 122 may be implemented on the interior surfaces of an opposing pair of the walls 104. The remainder of the interior 110 may be filled with sheets of the filler 130 similarly to embodiments of the armor 100 that are illustrated on FIGS. 3 and 4.

Figure 12:
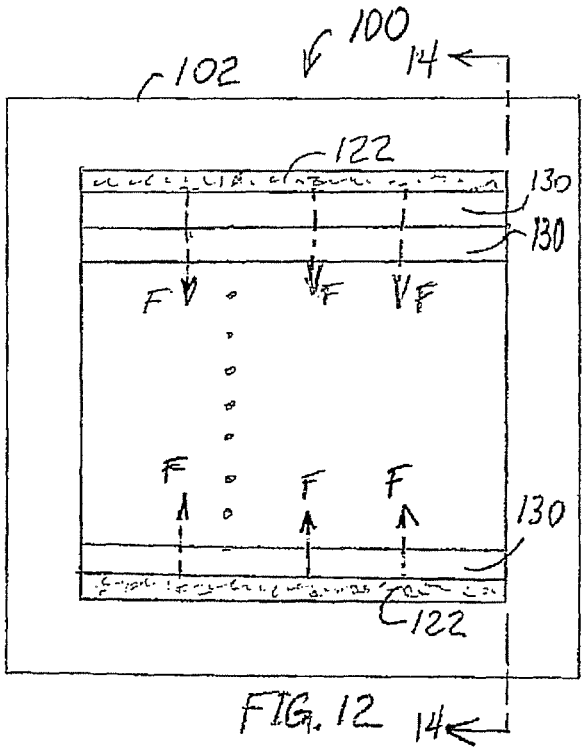

Referring to FIG. 12, two sheets of the explosive material 122 may be implemented on the interior surfaces of an opposing pair of the walls 104 similarly to embodiment of the armor 100 that is illustrated on FIG. 11. The remainder of the interior 110 may be filled with adjacent sheets of the filler 130 placed with major faces parallel to the sheets of the explosive 122 and edges positioned to face the back 106 and the strike face 108.

Figure 13:
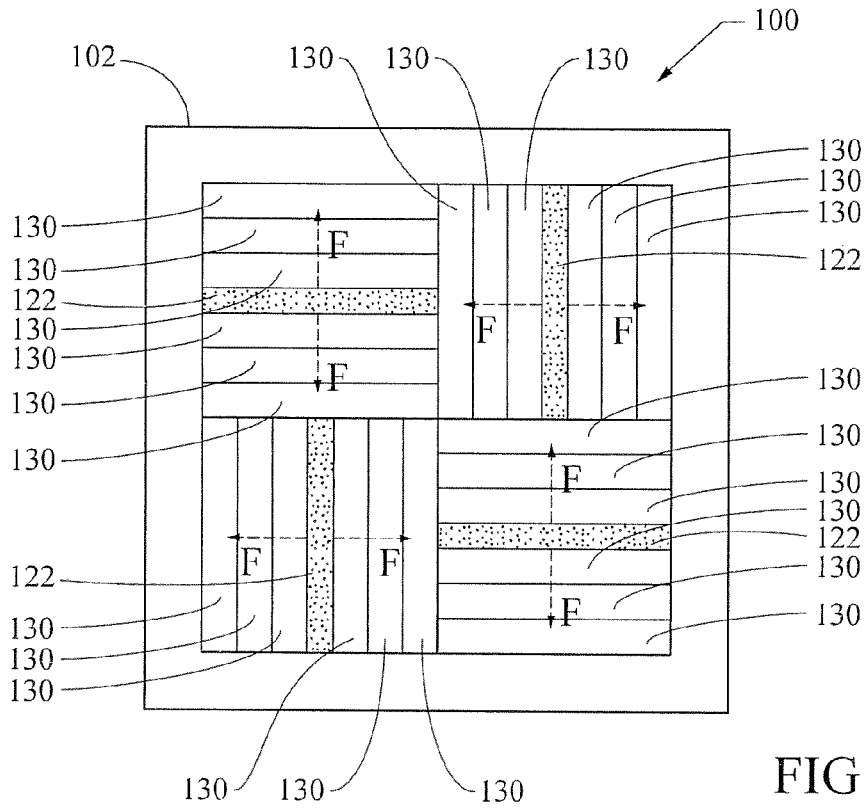

Referring to FIG. 13, the placement of explosive sheets 122 when viewed from the nominal strike face 108, may be implemented as a pair of "broken-Ts" (i.e., the cross bar and the vertical bar of the "T" shape are separated) that are placed (sandwiched) substantially centrally within the sheets of the fragmentable material 130, and oriented upside down with respect to each other. The positioning of the sheets of the filler 130 may be otherwise implemented as four first groupings, arrays, matrices, and the like in quadrants within the casing 102 substantially as illustrated on FIGS. 3 and 4. Alternatively, the embodiment of the armor 100 that is illustrated on FIG. 13 may be described as the sheets of the explosive 122 and the filler 130 are arranged and positioned in quadrants (i.e., in four first groupings) within the casing 102 that are perpendicular (i.e., rotated 90 degrees) to one another in succession, wherein each of the four sheets of the explosive 122 are placed (sandwiched) substantially centrally within the sheets of the fragmentable disruptive material 130.

Figure 14:
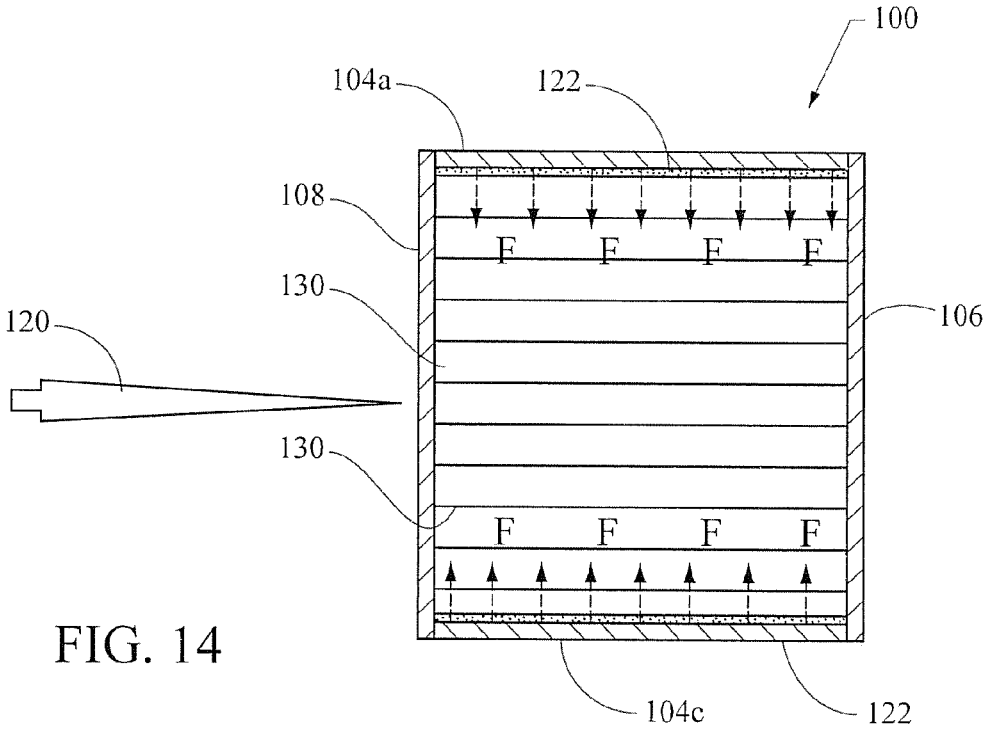
FIGS. 14-16 are sectional, side elevation views of embodiments of reactive armor according to the present invention.
Figure 15:
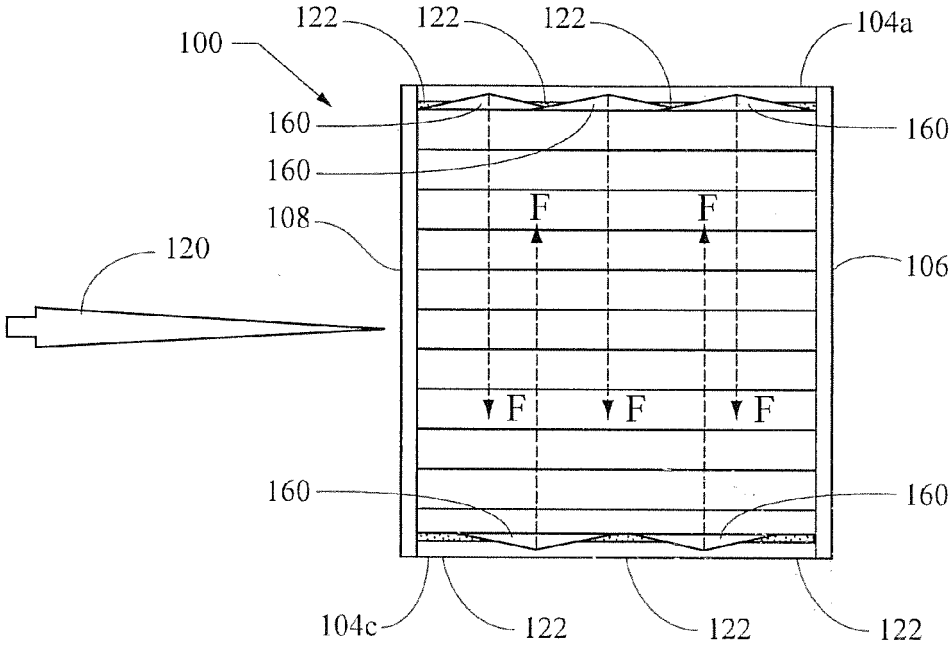
Figure 16:
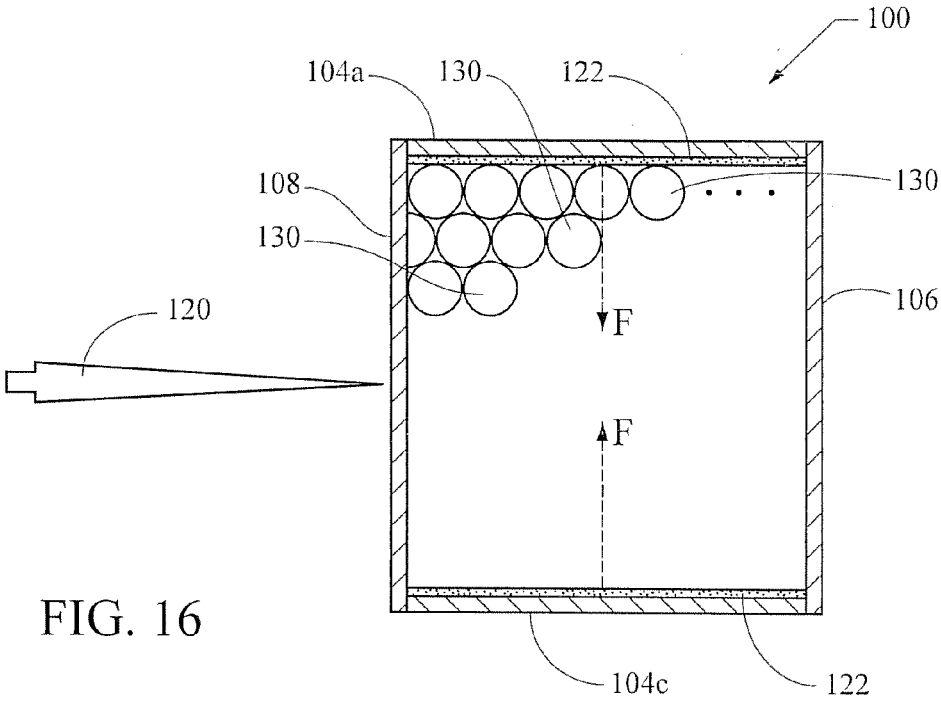

Referring to FIGS. 14-16, sectional views of the armor 100 when viewed from the side (e.g., with the wall 140*b* removed) are illustrated. Referring in particular to FIG. 14, a sectional view taken at the line 14-14 of the embodiment of the armor 100 that is illustrated on FIG. 12 is shown. The cover 108 is shown in the typically mounted position.

Referring to FIG. 15, another embodiment of the armor 100 is illustrated. The embodiment of the armor 100 that is illustrated on FIG. 15 may be implemented similarly to the embodiment of the armor 100 that is illustrated on FIG. 12. However, the embodiment of the armor 100 that is illustrated on FIG. 15 may implement the sheets of the explosive 122 as a plurality of trough configured shaped charges that are positioned to impinge the directed force, F, on the major faces of the sheets of the filler 130. The walls 104*a* and 104*c* may be scalloped to provide cavities 160. The cavities 160 may be (i) substantially empty in one example, (ii) filled with the explosive 122 in another example, and (iii) filled with the filler 130 in yet another example.

Referring to FIG. 16, another embodiment of the armor 100 is illustrated. The filler 130 may comprise a plurality of adjacently placed rods that are oriented with the longitudinal axes facing the strike face 108, and having the ends directed at the walls 104 not having the explosive 122 on the interior surface (i.e., the walls 104*b* and 104*d*). While cylindrical rods (i.e., rods having a circular cross sectional shape) of the filler 130 are illustrated on FIG. 16, any appropriate cross sectional shape may be implemented.

Figure 17:
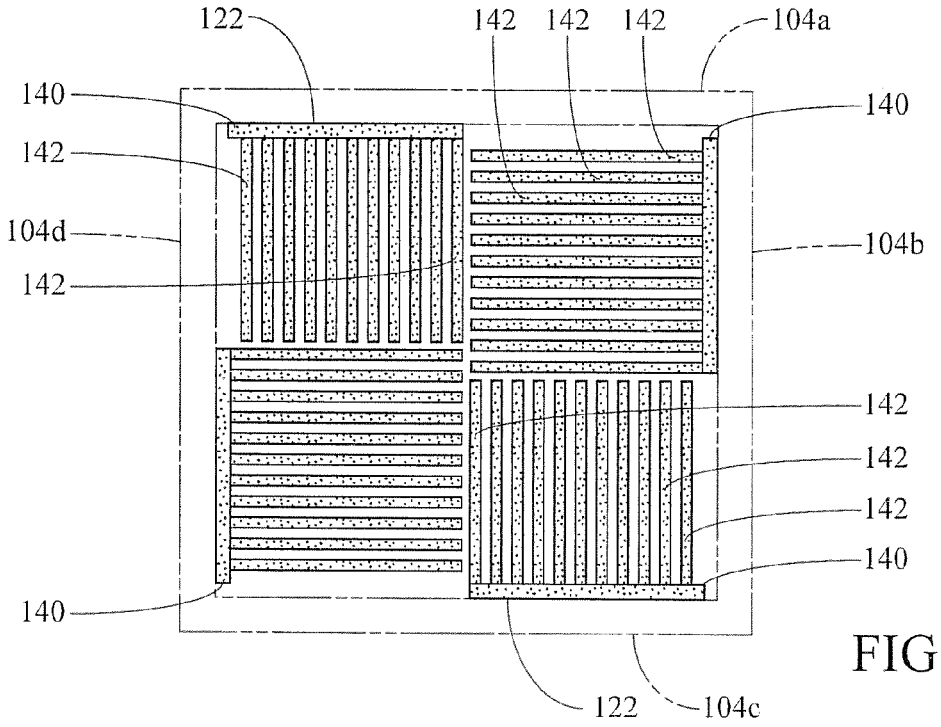
FIGS. 17 and 18 are plan views of embodiments of explosive implemented in connection with the reactive armor of the present invention.
Figure 18:
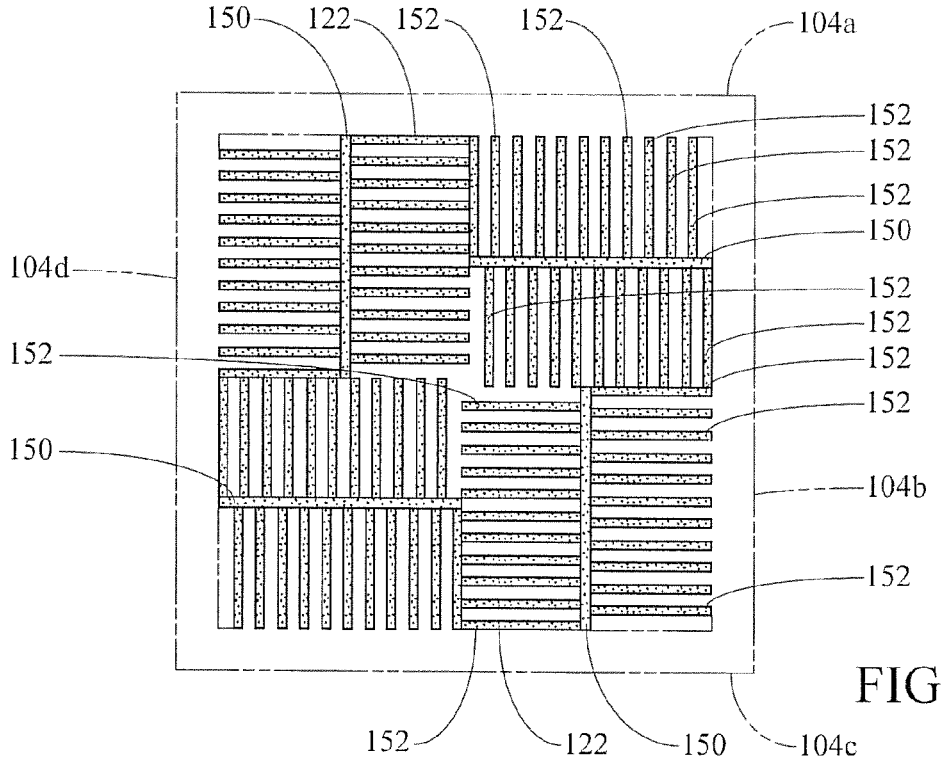

Referring to FIGS. 17 and 18, example embodiments of the explosive 122 as may be implemented within the casing 102 in connection with the back 106 and the cover 108 are illustrated. For clarity of illustration, the walls 104 are shown in phantom. The explosive 122 may be implemented as arrays (matrices) of strips, rods, cords, or the like. Such an implementation may provide initiation to other implementations of the explosive 122 (e.g., the explosive 122 that is sandwiched with the filler 130, the explosive 122 that is implemented adjacent to the walls 104, and the like), and reduce the outward directed explosive force and thus may potentially reduce or mitigate collateral damage, fratricide, and injury while effectively providing disruption to the intrusion 120.

Referring to FIG. 17, the explosive 122 may be implemented as comb shaped second quadrants (i.e., in four second groupings, explosive) initiators within the casing 102, and that are at 90 degree intervals of rotation to one another. Each of the quadrants may have a first leg (or bar) 140 that is substantially adjacent to a one half of a respective wall 104, and a plurality of second legs (or bars) 142 that extend perpendicular from one side of the respective first leg 140, and that are directed inward (i.e., towards the center of the casing 102). The implementation of the explosive 122 that is illustrated on FIG. 17 may be advantageously implemented in connection with the embodiments of the armor 100 that are illustrated on FIGS. 3-7 and 10.

Referring to FIG. 18, the explosive 122 may be implemented as second quadrants (i.e., in four second groupings, explosive groupings) initiators within the casing 102, and that are at 90 degree intervals of rotation to one another. Each of the quadrants of second groupings may have a first leg (or bar) 150 that substantially bisects one half of a respective wall 104 and is perpendicular to the respective wall 104, and a pair of a plurality of second legs (or bars) 152 that extend perpendicular from a respective first leg 150 and that are directed outward from both sides of the first leg 150 substantially parallel to the wall 104 that is intersected by the first leg 150, and that are staggered such that the second legs 152 on opposite sides of the first leg 150 do not intersect at the first leg 150 and are generally parallel to the sheets of filler 130. The implementation of the explosive 122 that is illustrated on FIG. 18 may be advantageously implemented in connection with the embodiment of the armor 100 that is illustrated on FIG. 13.

As is apparent then from the above detailed description, the present invention may provide an improved system for reactive armor.

Various alterations and modifications will become apparent to those skilled in the art without departing from the scope and spirit of this invention and it is understood this invention is limited only by the following claims.

What is claimed is:

1. Reactive armor comprising;

a casing having a plurality of walls, a back, and a rectangular shaped cavity formed therebetween;

a cover that closes the cavity and forms a strike face;

a filler placed within the cavity, the filler comprising a disruptive material, wherein the filler is implemented as adjacent cylindrical rods having circular cross sectional ends that face the back and the strike face, and the cylindrical rods are implemented in quadrants within the casing; and an explosive, wherein the cavity includes sheets of the explosive interspersed within the cavity between the cylindrical rods and edges of the sheets of the explosive face the strike face, wherein the quadrants are defined by sheets of the explosive traversing the interior in a substantially cross shape that bisects each of the walls.

2. The armor of claim 1, wherein the cylindrical rods further comprise at least one of glass, silicon nitride, silicon carbide, zirconia, and alumina.

* * * * *